US006557263B1

(12) United States Patent
Yeh

(10) Patent No.: US 6,557,263 B1
(45) **Date of Patent: *May 6, 2003**

(54) HAIRDRESSING SCISSORS

(76) Inventor: Wen-Ya Yeh, Suite 2, 15th Floor, No. 18, Chuney-Hsueh Road, Tainan (TW)

( * ) Notice: Subject to any disclaimer, the term of this patent is extended or adjusted under 35 U.S.C. 154(b) by 0 days.

This patent is subject to a terminal disclaimer.

(21) Appl. No.: 09/617,713

(22) Filed: Jul. 17, 2000

Related U.S. Application Data

(63) Continuation-in-part of application No. 09/228,345, filed on Jan. 11, 1999, now Pat. No. 6,192,590.

(51) Int. Cl.[7] ..... B26B 13/00
(52) U.S. Cl. ..... 30/226; 30/227; 30/254
(58) Field of Search ..... 30/254, 145, 146, 30/147, 226, 227, 229, 195, 196, 197

(56) References Cited

U.S. PATENT DOCUMENTS

| | | | | |
|---|---|---|---|---|
| 184,914 | A | 11/1876 | Scripps | 30/226 |
| 550,483 | A | 11/1895 | Carrier | |
| 1,012,918 | A | 12/1911 | Roelants et al. | 30/226 |
| 1,715,898 | A | 6/1929 | Carri | |
| 2,272,580 | A | 2/1942 | Phillips | |
| 2,456,858 | A | 12/1948 | Bolling | |
| 2,840,905 | A | 7/1958 | Geiger | |
| D267,996 | S | 2/1983 | Kowalski | 30/226 |
| 5,600,891 | A | 2/1997 | Orgal | 30/226 |
| 5,875,553 | A | 3/1999 | Geib, Jr. et al. | 30/226 |
| 5,996,592 | A | 12/1999 | Choy | 30/226 |
| 6,192,590 | B1 | 2/2001 | Yeh | 30/226 |

FOREIGN PATENT DOCUMENTS

| | | |
|---|---|---|
| GB | 1537614 | 1/1979 |
| GB | 2315037 | 1/1998 |

OTHER PUBLICATIONS

Houser et al., Cable Slitter, IBM technical disclosure bulletin, vol. 13 No. 10, Mar. 1971.

*Primary Examiner*—Allan N. Shoap
*Assistant Examiner*—Stephen Choi
(74) *Attorney, Agent, or Firm*—Alan Kamrath; Rider, Bennett, Egan & Arundel, LLP

(57) ABSTRACT

A pair of scissors includes two scissor element each having a handle and a blade. Each handle includes a through-hole and a connection block securely received in the through-hole. The connection block includes opposed first and second sides. A slot is defined in the first side of the connection block, and an engaging member is formed on the second side of the connection block. The slot of each connection block on one pair of scissors is releasably engaged with the engaging member of an associated connection block of another pair of scissors.

40 Claims, 9 Drawing Sheets

HAIRDRESSING SCISSORS

This is a continuation-in-part application of U.S. patent application Ser. No. 09/228,345 filed Jan. 11, 1999, now U.S. Pat. No. 6,192,590.

BACKGROUND OF THE INVENTION

1. Field of the Invention

The present invention relates to a pair of hairdressing scissors that can be releasably connected with another pair of hairdressing scissors. The present invention also relates to a hairdressing scissor assembly comprising a plurality of pair of scissors that are releasably connected with one another for cutting and/or thinning hair into a particular style in which the plurality of pair of scissors cut and/or thin hair by an amount different from one another.

2. Description of the Related Art

FIG. 9 of the drawings illustrates a conventional hairdressing scissor assembly that comprises a plurality of pair of scissors 30 combined together by a common pivot for cutting and/or thinning hair by a larger area. Nevertheless, each pair of scissors 30 cannot be detached from each other such that the user cannot determine the number of scissors. Namely, it is impossible or at least very difficult for the user to control the overall width of hair cut by the scissor assembly. In addition, it is very difficult for the user to cut and/or thin hair by a different amount by each pair of scissors 30, as all of the pairs of scissors are aligned with each other at their tips.

SUMMARY OF THE INVENTION

It is another object of the present invention to provide a pair of hairdressing scissors that can be easily and releasably attached to another pair of hairdressing scissors such that the user may control the number of pairs of hairdressing scissors on demand.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
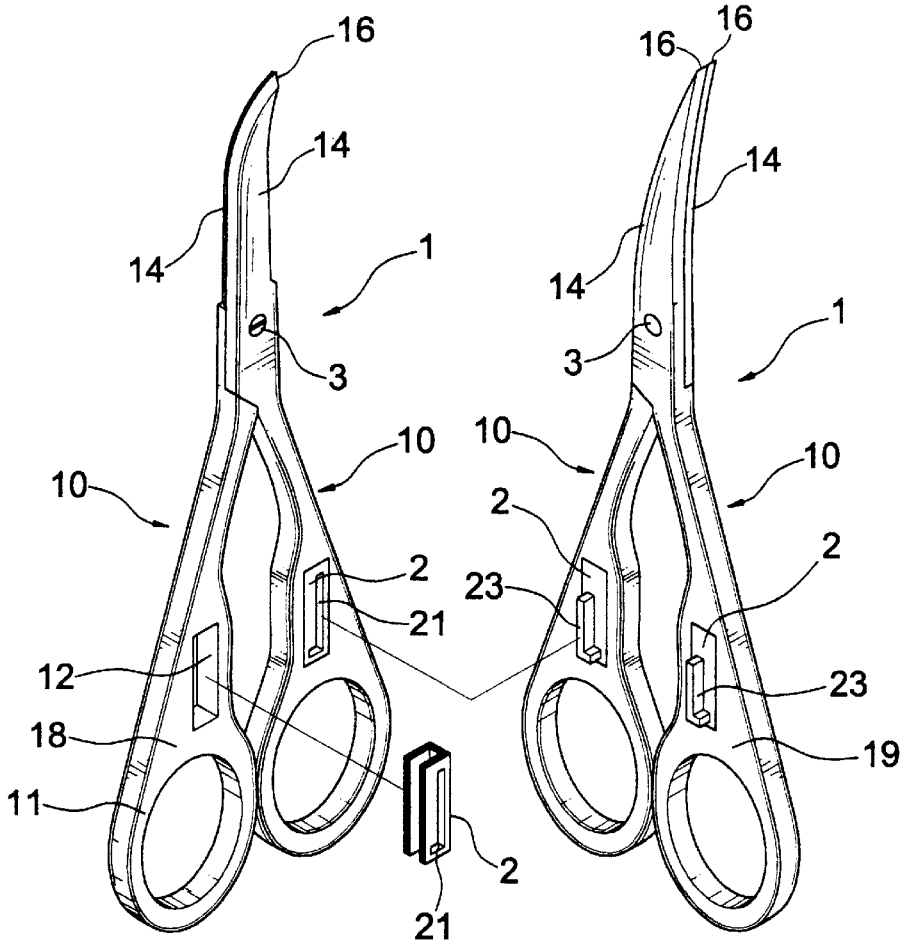
FIG. 1 is a perspective view of two pairs of hairdressing scissors in accordance with the present invention.
Figure 2:
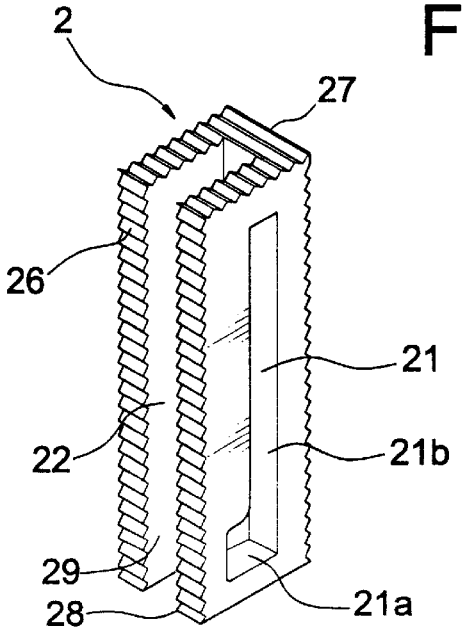
FIG. 2 is an enlarged perspective view of a connecting block in accordance with the present invention.
Figure 2A:
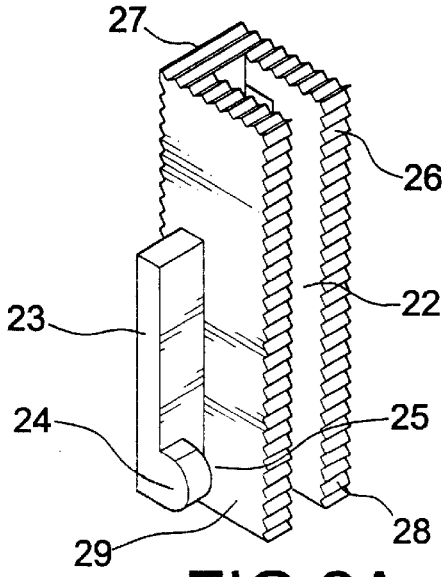
FIG. 2A is an enlarged perspective view illustrating the other side of the connection block in FIG. 2.
Figure 2B:
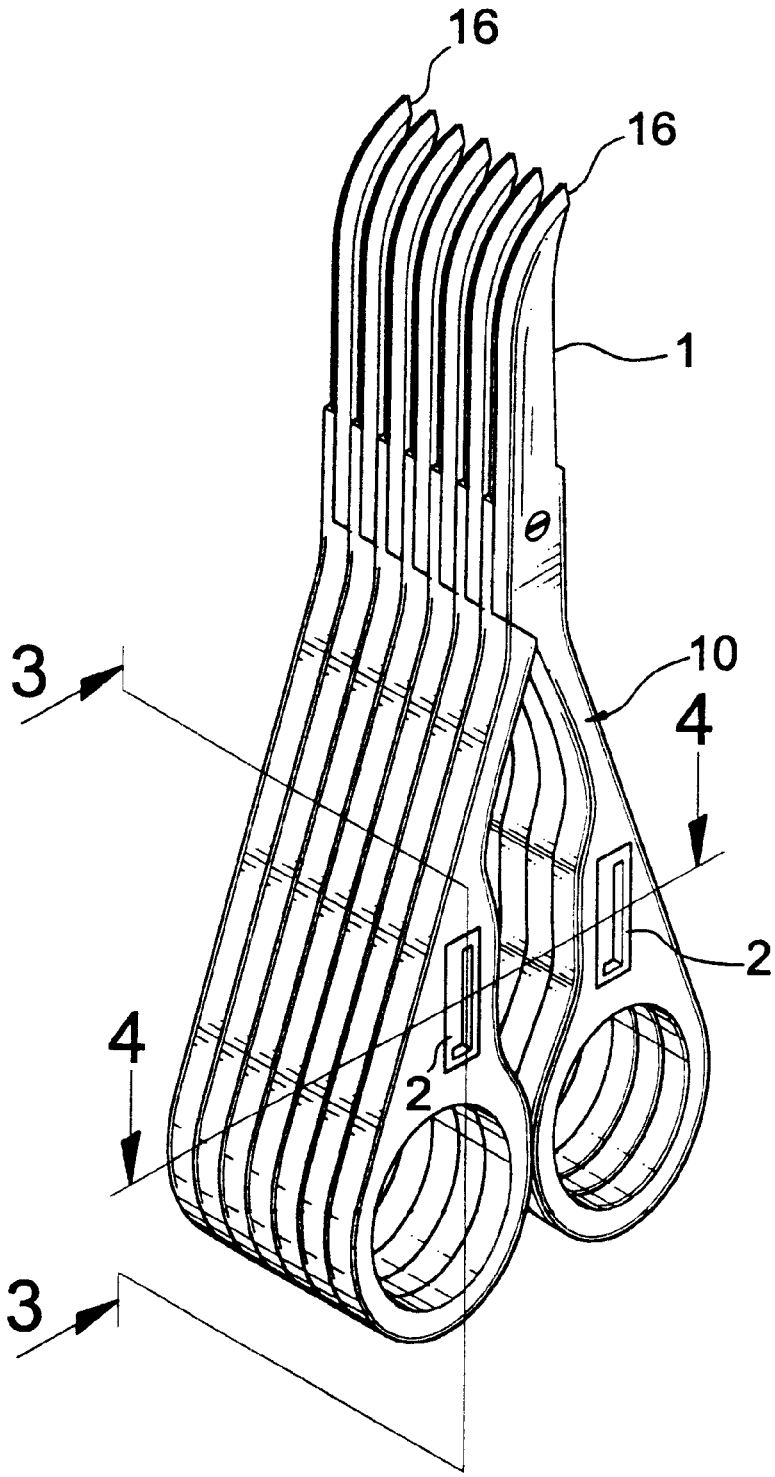
FIG. 2B is a perspective view of a hairdressing scissor assembly in accordance with the present invention that is constructed by a plurality of pairs of hairdressing scissors shown in FIG. 1.
Figure 3:
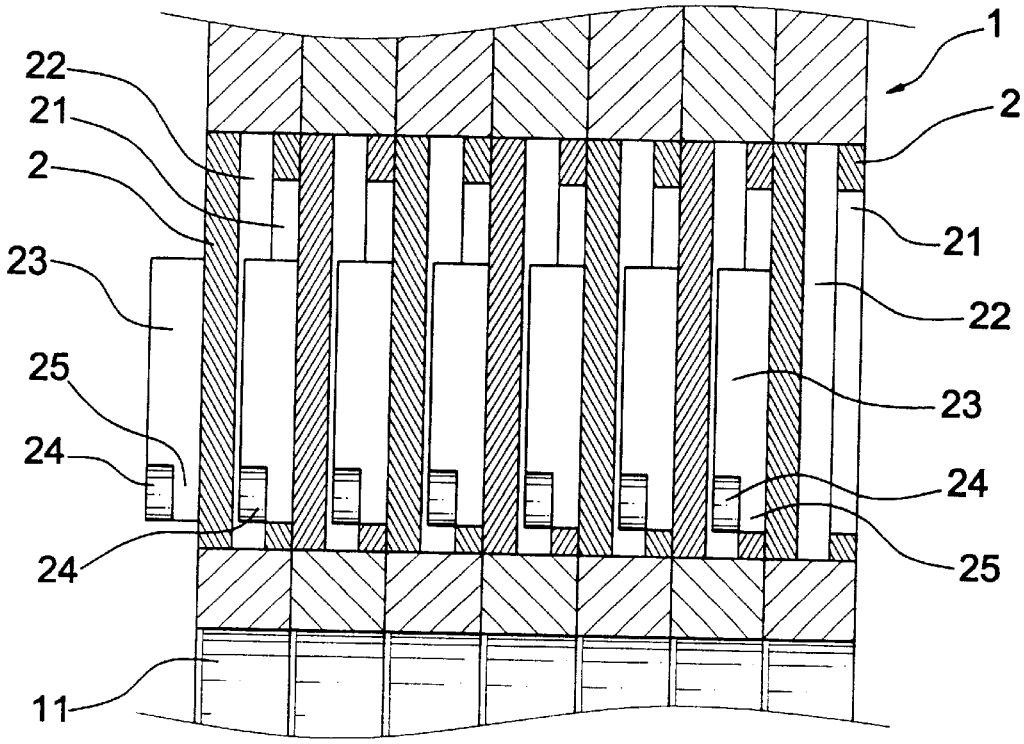
FIG. 3 is an enlarged partial sectional view taken along plane 3—3 in FIG. 2B.
Figure 4:
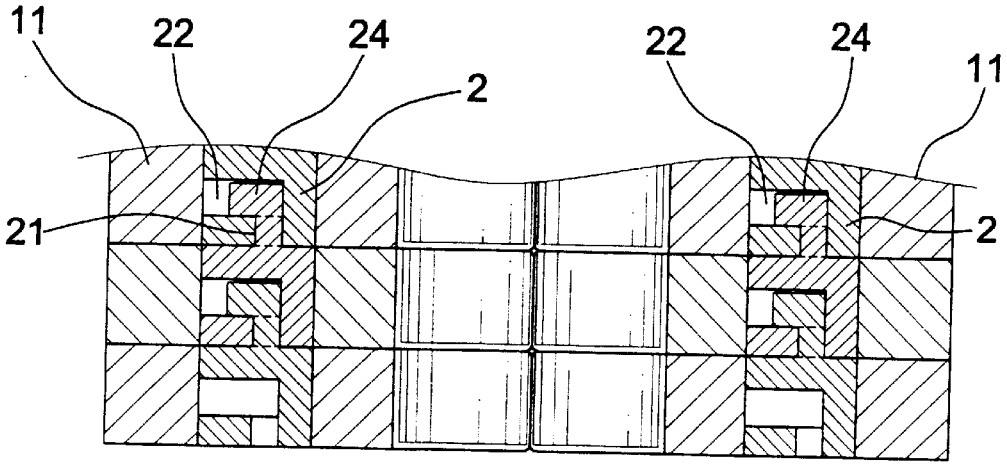
FIG. 4 is an enlarged partial sectional view taken along plane 4—4 in FIG. 2B.

Referring to FIG. 1, when connecting two pairs of hairdressing scissors 1, the engaging members 23 of the connection blocks 2 on one pair of hairdressing scissors 1 (the right one in FIG. 1) are inserted through the slots 21 of the connection blocks 2 on the other pair of hairdressing scissors 1 (the left one in FIG. 1). It is noted that the end lug 24 on each engaging member 23 on the pair or hairdressing scissors 1 (the right one) is inserted through a relatively shorter section 21*a* (FIG. 2) of an associated slot 21 of the other pair of scissors 1 (the left one) and enters the space 22 of an associated connection block 2 on the other pair of scissors 1. Each engaging member 23 on the pair of scissors 1 has a section (the longer one) snugly received in a relatively longer section 21*b* of the slot 21 of an associated connection block 2 on the other pair of scissors 1. The gap 25 of the engaging member 23 of each connection block 2 on the pair of scissors 1 (the right one) snugly receives a thickness of the wall 28 of the associated connection block 2 on the other pair of scissors 1. As illustrated in FIG. 2B, a hairdressing scissor assembly is constructed by means of connecting a plurality of pairs of hairdressing scissors 1 one by one on demand. Namely, the user may decide the total number of the pairs of the hairdressing scissor on demand. The engagement relationship between the connection blocks 2 of the scissors 1 are shown in FIGS. 3 and 4. It is noted that the scissors 1 are in a positioned ready for disengagement. The user may push the pairs of scissors 1 upward one by one relative to the previous pair of scissors 1 such that each end lug 24 of each pair of scissors 1 moved in the space 22 of the associated connection block 2 to a position not aligned with the shorter section 21*a* of the associated slot 21 of the associated pair of scissors 1. Thus, each pair of scissors 1 is in an engaged position, best shown in FIG. 5.

Figure 5:
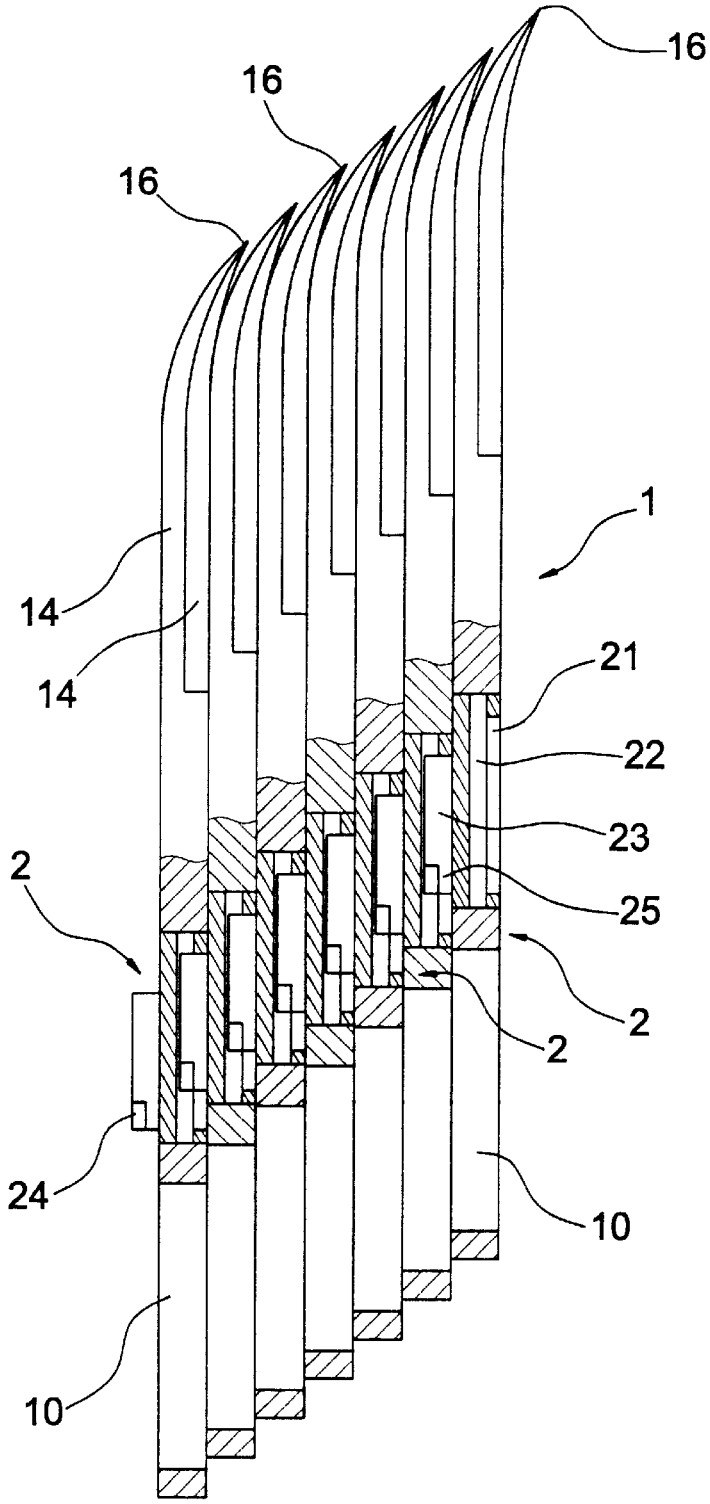
FIG. 5 is a partial sectional view similar to FIG. 3, wherein all pairs of scissors forming the hairdressing scissor assembly in FIG. 2B are in an engaged position to prevent disengagement.

As illustrated in FIG. 5, when in a closed status, the tips 16 of the pairs of scissors 1 forming the hairdressing scissor assembly are aligned along an inclined line and located at different levels. This allows the user to cut and/or thin hair to form a particular, good-looking hairstyle that is popular in hair styling designs.

Figure 6:
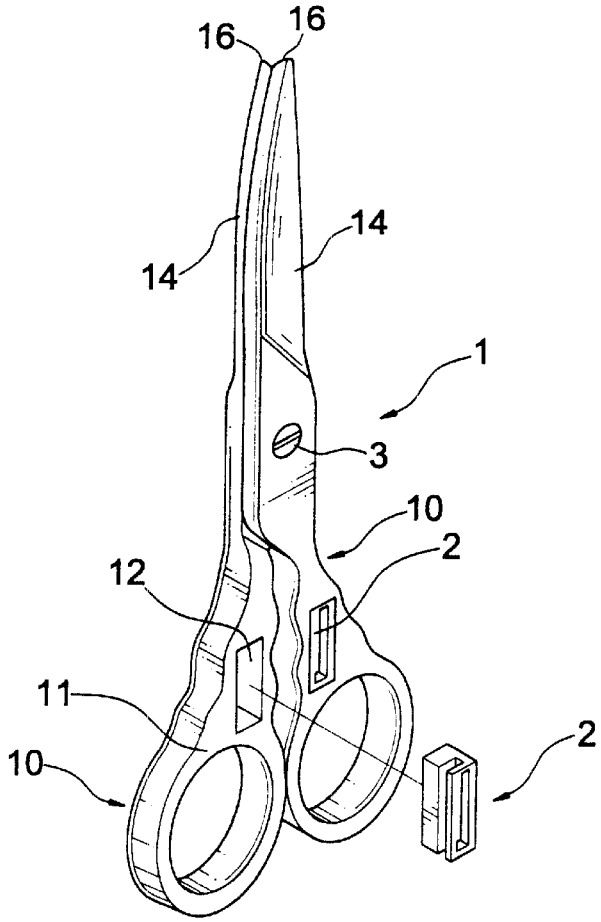
FIG. 6 is an exploded perspective view of a pair of hairdressing scissors having a modified embodiment of the connection block.
Figure 7:
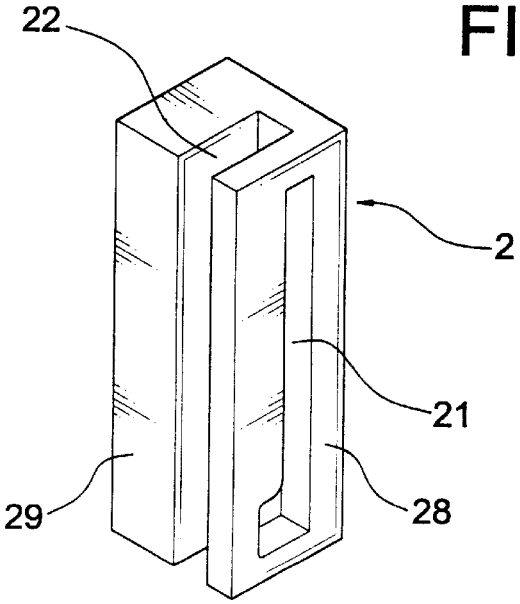
FIG. 7 is an enlarged perspective view of the connecting block in FIG. 6
Figure 7A:
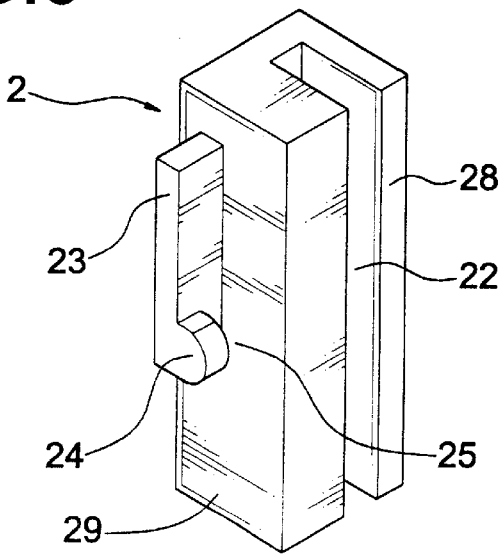
FIG. 7A is an enlarged perspective view illustrating the other side of the connection block in FIG. 7.
Figure 7B:
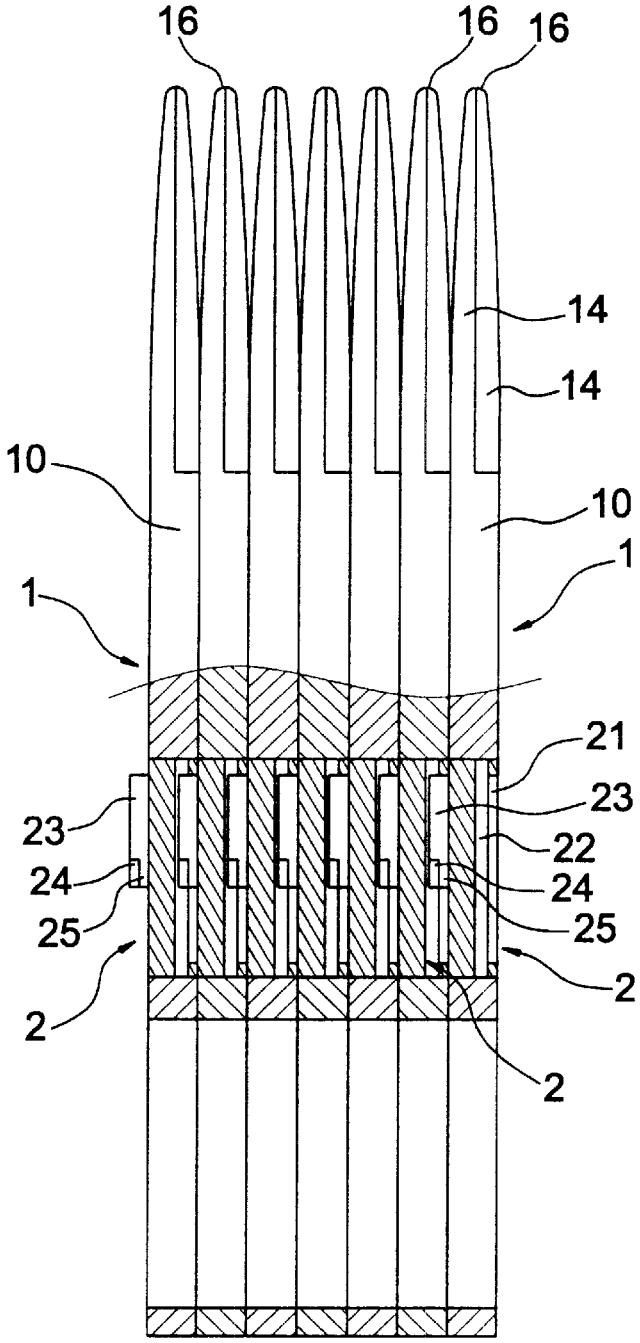
FIG. 7B is a partial sectional view of a hairdressing scissor assembly that is constructed by a plurality of pairs of hairdressing scissors shown in FIG. 7.

FIG. 6 illustrates a pair of scissors with a modified connection block 2, wherein the serrations 26 on the connection block 2 in the first embodiment (FIGS. 2 and 2A) are removed and the engaging member 23 on the wall 29 of the connection block 2 is located at a higher position, best shown in FIGS. 7 and 7A. By this arrangement, as illustrated in FIG. 7B, when in a closed status, the tips 16 of the pairs of scissors 1 forming the hairdressing scissor assembly are aligned with each other and located at the same level. The wall 29 of the connection block 2 has a larger width so as to be used with a scissor element having a wide handle.

Figure 8:
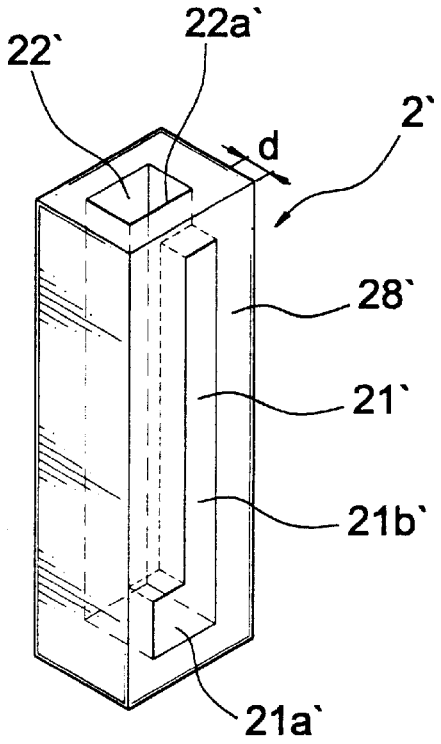
FIG. 8 is an enlarged perspective view of another modified embodiment of the connecting block.
Figure 8A:
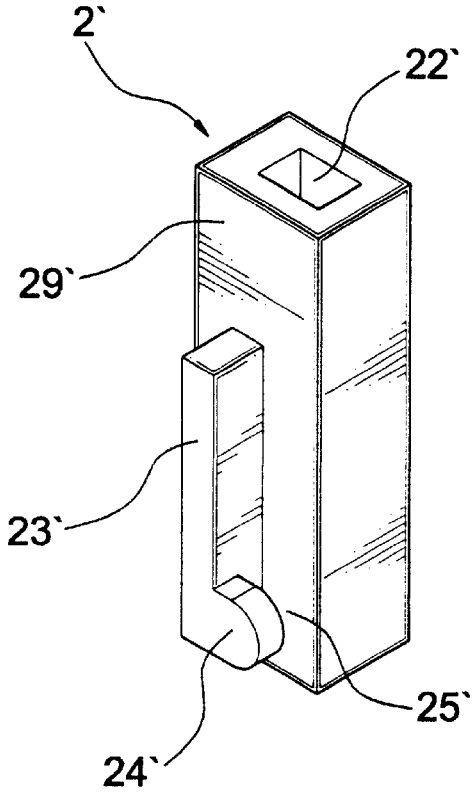
FIG. 8A is an enlarged perspective view illustrating the other side of the connection block in FIG. 8.

FIGS. 8 and 8A illustrate another modified embodiment of the connection block (now designated by 2'). In this embodiment, the connection block 2' includes a longitudinal hole 22' (preferably rectangular), a substantially L-shape slot 21' defined in a first side 28' thereof and communicated with the longitudinal hole 22', and substantially L-shape engaging member 23' formed on a second side 29' thereof that is opposite to the first side 28'. The engaging member 23' includes an end lug 24' and a gap 25' is defined between the end lug 24' and the second side 29' of the connection block 2'. The hole 22' may be a through-hole to allow easy manufacture of the connection block 2'.

When connecting two pairs of hairdressing scissors 1, the engaging members 23' of the connection blocks 2' on one pair of hairdressing scissors 1 are inserted through the slots 21' of the connection blocks 2' on the other pair of hairdressing scissors 1. It is noted that the end lug 24' on each engaging member 23' on the pair of hairdressing scissors 1 is inserted through a relatively shorter section 21*a*' of an associated slot 21' of the other pair of scissors 1 and enters the longitudinal hole 22' of an associated connection block 2' on the other pair of scissors 1. Each engaging member 23' on the pair of scissors 1 includes a section (the longer one) snugly received in a relatively longer section 21*b*' of the slot 21' of an associated connection block 2' on the other pair of scissors 1. The gap 25' of the engaging member 23' of each connection block 2' on the pair of scissors 1 snugly receives a thickness d of the associated connection block 2' on the other pair of scissors 1. As illustrated in FIG. 8, the thickness d is a distance between the first side 28' of the connection block 2' and a wall 22*a*' of the longitudinal hole 22' that is most adjacent to the first side 28'.

Figure 8B:
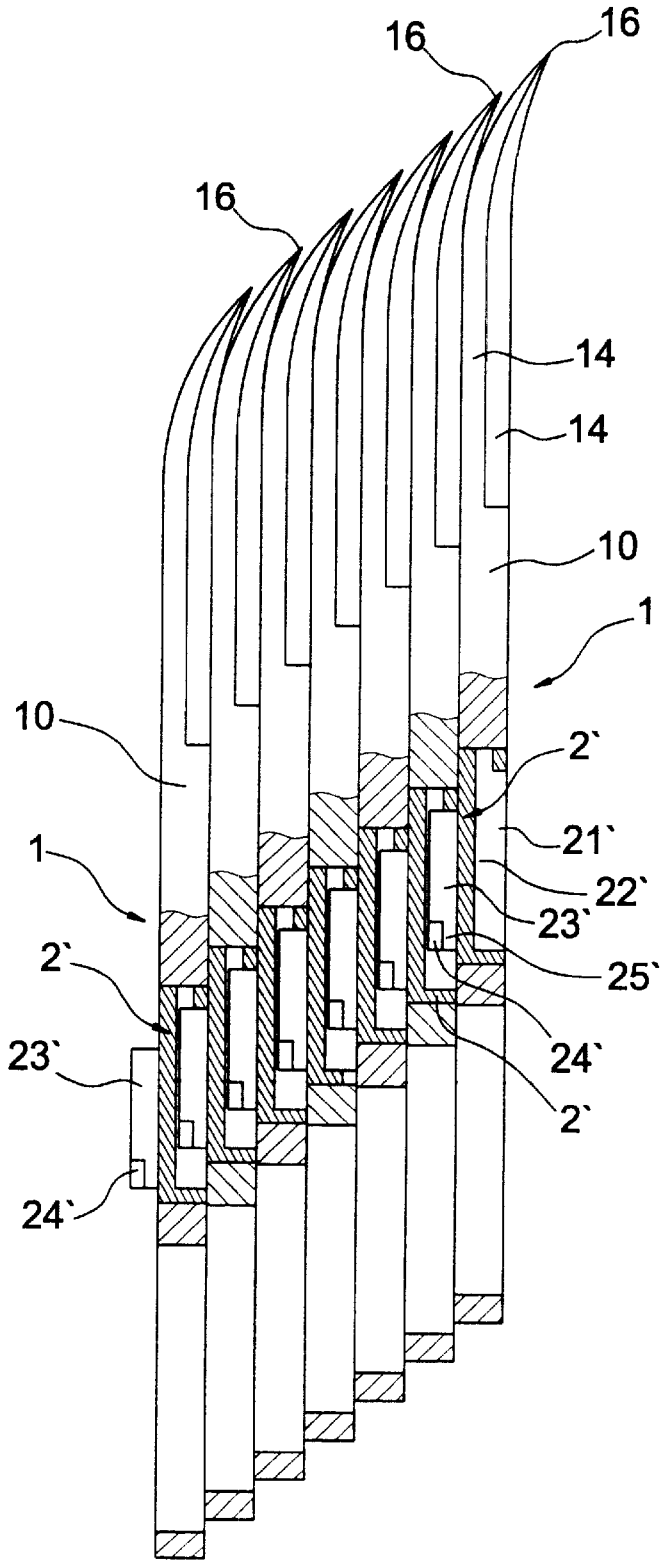
FIG. 8B is a partial sectional view of a hairdressing scissor assembly that is constructed by a plurality of pairs of hairdressing scissors with connection blocks each having a structure shown in FIGS. 8 and 8A.
Figure 9:
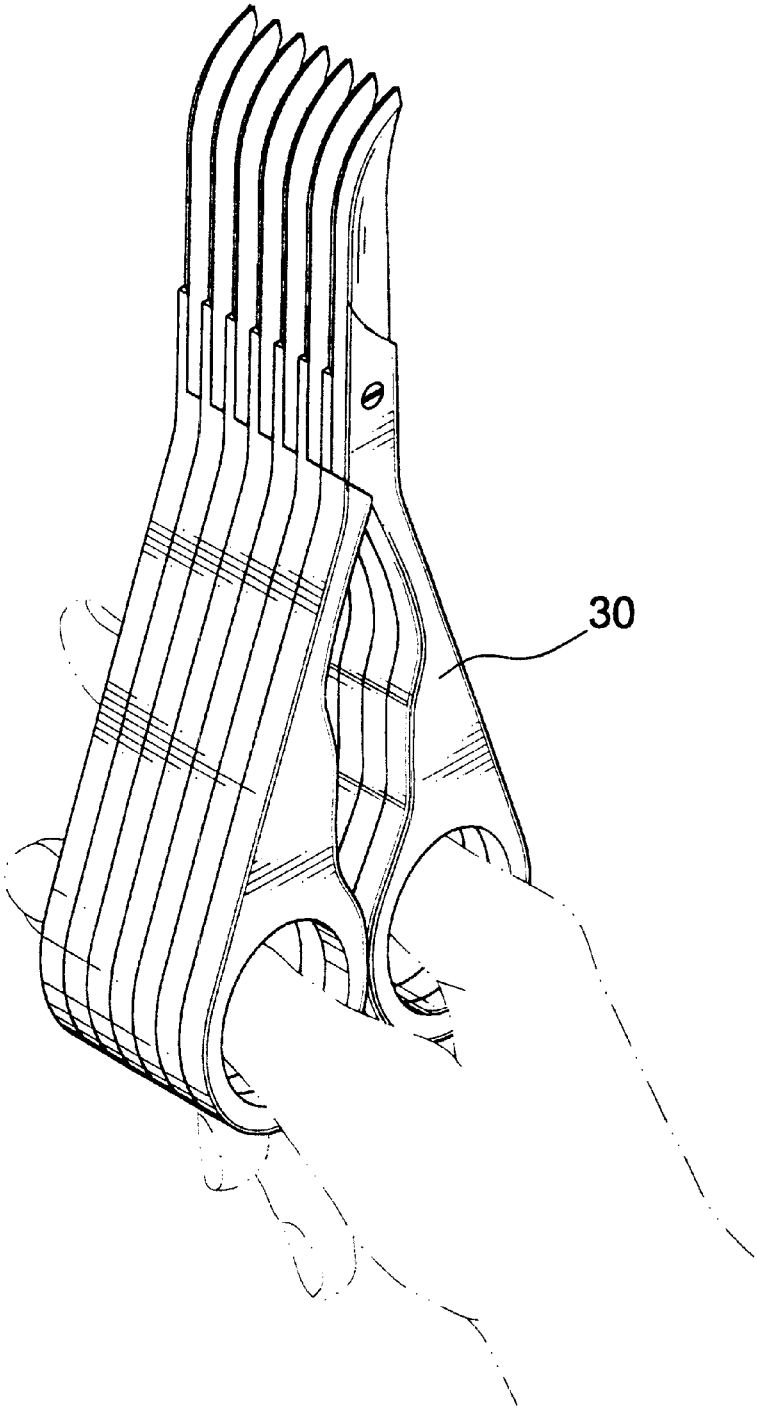
FIG.9 PRIOR ART
FIG. 9 is a perspective view of a conventional hairdressing scissor assembly.

As illustrated in FIG. 8B, a hairdressing scissor assembly is constructed by means of connecting a plurality of pairs of hairdressing scissors 1 one by one on demand. Namely, the user may decide the total number of the pairs of the hairdressing scissors on demand. The user pushes the pairs of scissors 1 upward one by one relative to the previous pair of scissors 1 such that the end lugs 24' of each pair of scissors 1 are moved in the longitudinal hole 22' of the associated connection blocks 2' to a position not aligned with the shorter sections 21*a*' of the associated slots 21' of the associated pair of scissors 1. Thus, each pair of scissors 1 is in an engaged position ready for cutting and/or thinning hair. In addition, when in a closed status, the tips 1*a* of the pairs of scissors 1 forming the hairdressing scissor assembly are aligned along an inclined line and yet located at different levels. This allows the user to cut and/thin hair to form a particular, good-looking hairstyle that is popular in hair styling designs.

According to the above description, it is appreciated that the scissors in accordance with the present invention can be engaged with one another to form a hairdressing scissor assembly on demand. The total number of pairs of the scissors can be determined by the user. In addition, the tips of the scissors forming the hairdressing scissor assembly may be located at the same level or different levels to cut and/or thin hair into a particular style. The snug engagement between the slot 21 and the associated engaging member 23 and snug engagement between the gap 25 and the associated wall thickness prevent wobbling of each pair of scissors 1. It is noted that the scissors disclosed herein are not limited to hairdressing. In addition, the user may insert one finger through all of aligned handles on a half portion of the scissor assembly with another finger inserted through only the first handle on the other half portion of the scissor assembly. Namely, in each pair of scissors only one handle is equipped with the connection block 2 instead of the both of them, which suffices operation of the overall scissor assembly.

Although the invention has been explained in relation to its preferred embodiment, it is to be understood that many other possible modifications and variations can be made without departing from the scope of the invention as hereinafter claimed.

What is claimed is:

1. A pair of scissors comprising a pair of elements pivotally connected by a pivot extending in an axial direction; a first side; and a second side opposed to the first side in the axial direction, the first side including a first engaging means and the second side including a second engaging means, the first engaging means of the pair of scissors being adapted to be releasably engaged with a second engaging means of another pair of said scissors and the second engaging means of the pair of scissors being adapted to be releasably secured with a first engaging means of a further pair of said scissors.

2. A pair of scissors comprising two scissor elements each comprising a handle and a blade, each said handle comprising a through-hole and a connection block securely received in the through-hole, the connection block including opposed first and seconds sides, a first engaging means being formed on the first side of the connection block, a second engaging means being formed on the second side of the connection block, said through-holes of said pair of scissor element being spaced apart so as to be movable towards and away from each other during operation of the scissors, the first engaging means of each said connection block on the pair of scissors being adapted to be releasably engaged with a second engaging means of a connection block of a pair of similarly constructed scissors.

3. The pair of scissors as claimed in claim 2, wherein each said connection block is a U-shape member including a first wall, a second wall, and a connecting wall between the first wall and the second wall, thereby defining a space therebetween.

4. The pair of scissors as claimed in claim 3, wherein the first wall, the second wall, and the connecting wall include a plurality of serrations for securely engaging with an associated said through-hole.

5. The pair of scissors as claimed in claim 3, wherein the first engaging means is an L-shape slot defined in the first wall, the L-shape slot having a first section and a second section.

6. The pair of scissors as claimed in claim 5, wherein the second engaging means is an engaging member formed on an outer side of the second wall.

7. The pair of scissors as claimed in claim 6, wherein the engaging member is substantially L-shape and includes an end lug, the end lug and the second wall having a gap therebetween.

8. The pair of scissors as claimed in claim 7, wherein the engaging member includes a section that is received and guided in a first section of an L-shape slot of the pair of similarly constructed scissors.

9. The pair of scissors as claimed in claim 7, wherein the end lug of the engaging member is passable through a second section of said L-shape slot of the pair of similarly constructed scissors.

10. The pair of scissors as claimed in claim 9, wherein the end lug of the engaging member is received and guided in a space of said connection block of the pair of similarly constructed scissors.

11. The pair of scissors as claimed in claim 10, wherein the gap snugly receives a wall thickness of a second wall of the connection block of the pair of similarly constructed scissors.

12. The pair of scissors as claimed in claim 2, wherein each said connection block includes a longitudinal hole, the first side of each said connection block including an L-shape slot that forms the first engaging means and that includes a first section and a second section, the second section of the L-shape slot being communicated with the longitudinal hole.

13. The pair of scissors as claimed in claim 12, wherein the second engaging means is an engaging member formed on the second side of said connection block.

14. The pair of scissors as claimed in claim 13, wherein the engaging member is substantially L-shape and includes an end lug, the end lug and the second side of the connection block having a gap therebetween.

15. The pair of scissors as claimed in claim 14, wherein the engaging member of the pair of scissors includes a section that is received and guided in a first section of an L-shape slot of a connection block of a pair of similarly constructed scissors.

16. The pair of scissors as claimed in claim 15, wherein the end lug of the engaging member of the pair of scissors is passable through a second section of the L-shape slot of the connection block of the pair of similarly constructed scissors.

17. The pair of scissors as claimed in claim 16, wherein the end lug of the engaging member of the pair of scissors is received and guided in a longitudinal hole of the connection block of the pair of similarly constructed scissors.

18. The pair of scissors as claimed in claim 17, wherein the gap of the pairs of scissors receives a wall thickness between a first side of the connection block of the pair of similarly constructed scissors and a wall of the longitudinal hole of the connection block of the pair of similarly constructed scissors that is most adjacent to the first side of the connection block of the pair of similarly constructed scissors.

19. A scissor assembly comprising at least first, second and third pairs of scissors each having opposed first and seconds sides, the first side of each of said at least first, second and third pairs of scissors including a first engaging means and the second side of each of said at least first, second and third pairs of scissors including a second engaging means, the first engaging means of the first pair of scissors being releasably engaged with the second engaging means of the second pair of scissors and the first engaging means of the second pair of scissors being releasably engaged with the second engaging means of the third pair of scissors.

20. The scissor assembly as claimed in claim 19, wherein each of said at least three pairs of scissors has two scissor elements each having a blade with a tip, all of the tips of said at least three pairs of scissors being aligned with each other and located on the same level when the scissor assembly is in a closed status.

21. The scissor assembly as claimed in claim 19, wherein each of said at least three pairs of scissors has two scissor elements each having a blade with a tip, all of the tips of each respective pair of scissors being aligned along an inclined line and located at different levels when the scissor assembly is in a closed status.

22. A scissor assembly comprising a plurality pairs of scissors each having two scissor elements, each said scissor element comprising a handle and a blade, each said handle comprising a through-hole and a connection block securely received in the through-hole, the connection block including opposed first and second sides, a first engaging means being formed on the first side of the connection block, a second engaging means being formed on the second side of the connection block, said through-holes of each respective pair of scissor elements being spaced apart so as to be moveable towards and away from each other during operation of the scissors, the first engaging means of each said connection block on the pair of scissors being releasably engaged with a second engaging means of a connection block of a pair of similarly constructed scissors.

23. The scissor assembly as claimed in claim 22, wherein each said connection block is a U-shape member including a first wall, a second wall, and a connecting wall between the first wall and the second wall, thereby defining a space therebetween.

24. The scissor assembly as claimed in claim 23, wherein the first wall, the second wall, and the connecting wall include a plurality of serrations for securely engaging with an associated said through-hole.

25. The scissor assembly as claimed in claim 23, wherein the first engaging means is an L-shape slot defined in the first wall, the L-shape slot having a first section and a second section.

26. The scissor assembly as claimed in claim 25, wherein the second engaging means is an engaging member formed on an outer side of the second wall.

27. The scissor assembly as claimed in claim 26, wherein the engaging member is substantially L-shape and includes an end lug, the end lug and the second wall having a gap therebetween.

28. The scissor assembly as claimed in claim 27, wherein the engaging member of one pair of said scissors includes a section that is snugly received and guided in the first section of an associated said L-shape slot of another pair of said scissors.

29. The scissor assembly as claimed in claim 27, wherein the end lug of the engaging member of one pair of said scissors is passable through the second section of an associated said L-shape slot of another pair of said scissors.

30. The scissor assembly as claimed in claim 29, wherein the end lug of the engaging member of one pair of said scissors is received and guided in the space of an associated said connection block of another pair of said scissors.

31. The scissor assembly as claimed in claim 30, wherein the gap of one pair of said scissors receives a wall thickness of the second wall of the associated connection block of another pair of said scissors.

32. The scissor assembly as claimed in claim 22, wherein each said connection block includes a longitudinal hole, the first side of each said connection block including an L-shape slot that forms the first engaging means and that includes a first section and a second section, the second section of the L-shape slot being communicated with the longitudinal hole.

33. The scissor assembly as claimed in claim 32, wherein the second engaging means is an engaging member formed on the second side of said connection block.

34. The scissor assembly as claimed in claim 33, wherein the engaging member is substantially L-shape and includes an end lug, the end lug and the second side of the connection block having a gap therebetween.

35. The scissor assembly as claimed in claim 34, wherein the engaging member of one pair of said scissors includes a section that is received and guided in the first section of an associated said L-shape slot of another pair of said scissors.

36. The scissor assembly as claimed in claim 35, wherein the end lug of the engaging member of one pair of said scissors is passable through the second section of an associated said L-shape slot of another pair of said scissors.

37. The scissor assembly as claimed in claim 36, wherein the end lug of the engaging member of one pair of said scissors is received and guided in the longitudinal hole of an associated said connection block of another pair of said scissors.

38. The scissor assembly as claimed in claim 37, wherein the gap of one pair of said scissors receives a wall thickness between the first side of the associated connection block of another pair of said scissors and a wall of the longitudinal hole of the associated connection block of another pair of said scissors that is most adjacent to the first side of the associated connection block of another pair of said scissors.

39. The scissor assembly as claimed in claim 22, wherein each said blade has a tip, and all of the tips of all of said pairs of scissors are aligned with each other and located on the same level when the scissor assembly is in a closed status.

40. The scissor assembly as claimed in claim 22, wherein each said blade has a tip, and all of the tips of each respective pair of scissors are aligned along an inclined line and located at different levels when the scissor assembly is in a closed status.

* * * * *